US010207501B2

(12) United States Patent
Sakai et al.

(10) Patent No.: US 10,207,501 B2
(45) Date of Patent: Feb. 19, 2019

(54) INK JET RECORDING METHOD AND INK JET RECORDING APPARATUS

(71) Applicant: CANON KABUSHIKI KAISHA, Tokyo (JP)

(72) Inventors: Junichi Sakai, Machida (JP); Takashi Saito, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/290,030

(22) Filed: Oct. 11, 2016

(65) Prior Publication Data

US 2017/0120592 A1 May 4, 2017

(30) Foreign Application Priority Data

Oct. 30, 2015 (JP) ..... 2015-213660

(51) Int. Cl.
*B41J 2/14* (2006.01)

(52) U.S. Cl.
CPC ..... *B41J 2/14088* (2013.01); *B41J 2/14129* (2013.01)

(58) Field of Classification Search
CPC combination set(s) only.
See application file for complete search history.

(56) References Cited

U.S. PATENT DOCUMENTS 6,474,790 B2 * 11/2002 Kaneko ..... B41J 2/14024 347/59
6,962,405 B2 * 11/2005 Imanaka ..... B41J 2/14072 347/58
7,604,340 B2 * 10/2009 Koga ..... C09D 11/40 106/31.13
7,607,772 B2 * 10/2009 Koga ..... C09D 11/40 106/31.13
7,766,471 B2 * 8/2010 Kato ..... C09D 11/40 106/31.13
7,988,277 B2 * 8/2011 Moribe ..... C09D 11/40 106/31.27

(Continued)

FOREIGN PATENT DOCUMENTS

JP S63-191646 8/1988
JP 2003-266701 9/2003

*Primary Examiner* — Matthew Luu
*Assistant Examiner* — Lily Kemathe
(74) *Attorney, Agent, or Firm* — Venable LLP

(57) ABSTRACT

An ink let recording method using an apparatus including plural aqueous inks, a recording head having a heat-generating portion to eject the inks, and ink storage portions therefor which are housings bonded to the recording head, the method including ejecting the inks from the recording head to record an image on a recording medium. The recording head has plural ejection orifice arrays corresponding to the inks and including a first and a second ejection orifice array at both sides and a third ejection orifice array at the other positions. A protective layer containing tantalum or tantalum oxide is formed on the heat-generating portion to contact with the inks. Dynamic surface tension and lightness of the ink corresponding to the third ejection orifice array are respectively smaller than maximum dynamic surface tension and larger than minimum lightness of the inks corresponding to the first and second ejection orifice arrays.

14 Claims, 3 Drawing Sheets

(56) References Cited

U.S. PATENT DOCUMENTS

| | | | | |
|---|---|---|---|---|
| 8,784,549 | B2 * | 7/2014 | Bermel | C09D 11/322 106/31.6 |
| 9,539,836 | B2 * | 1/2017 | Fukui | C09D 11/101 |
| 2006/0238590 | A1 * | 10/2006 | Koga | C09D 11/40 347/100 |
| 2007/0022902 | A1 * | 2/2007 | Koga | C09D 11/40 106/31.27 |
| 2007/0120928 | A1 * | 5/2007 | Ma | C09D 11/38 347/100 |
| 2007/0186812 | A1 * | 8/2007 | Koga | C09D 11/40 106/31.58 |
| 2008/0018722 | A1 * | 1/2008 | Mafune | C09D 11/322 347/100 |
| 2008/0207805 | A1 * | 8/2008 | Blease | C09D 11/324 524/145 |
| 2008/0280043 | A1 * | 11/2008 | Moribe | C09D 11/40 427/256 |
| 2010/0225707 | A1 * | 9/2010 | Kudo | C09D 11/328 347/56 |
| 2015/0239268 | A1 * | 8/2015 | Fukui | C09D 11/101 347/9 |

* cited by examiner

INK JET RECORDING METHOD AND INK JET RECORDING APPARATUS

BACKGROUND OF THE INVENTION

Field of the Invention

The present invention relates to an ink jet recording method and an ink jet recording apparatus.

Description of the Related Art

An ink jet recording method enables recording of images on various recording media. In order to produce better images, various inks, such as inks suited for recording photographic quality images on glossy paper and the like and inks suited for recording documents on plain paper and the like, have been developed according to purposes.

In recent years, the ink jet recording method is also used, for example, for recording business documents containing characters, diagrams, and the like on plain paper or similar recording media, and has been markedly frequently used for such purposes. As the technique of the ink jet recording method develops, ink jet recording apparatuses are required to have higher durability and reliability to achieve high productivity for a long period of time. To meet such a demand, a recording head that ejects an ink by the action of thermal energy has been improved to reduce damages even when the accumulated number of ejection actions increases. For example, a recording head in which a protective layer is provided on a face of a heat-generating portion (heater) that comes in contact with an ink is disclosed (Japanese Patent Application Laid-Open No. S63-191646).

To increase the accumulated number of recordable images, the inventors of the present invention have conducted investigations by using an ink jet recording apparatus provided with a recording head including a protective layer containing tantalum. The result has indicated that the number of recordable images can be dramatically increased as compared with an ink jet recording apparatus provided with a recording head including no protective layer containing tantalum. However, it has been revealed that bleeding is likely to be caused on images recorded with a plurality of aqueous inks when a recording head is bonded to a housing constituting an ink storage portion without other members such as a heat-dissipating plate interposed therebetween.

An object of the present invention is thus to solve the problems caused when an ink jet recording apparatus having the structure in which a housing constituting an ink storage portion is bonded to a recording head including a protective layer containing tantalum is used to record images with a plurality of aqueous inks. In other words, the present invention aims to provide an ink jet recording method that enables recording of images on which bleeding is suppressed even when the above ink let recording apparatus is used. The present invention also aims to provide an ink jet recording apparatus used in the ink jet recording method.

SUMMARY OF THE INVENTION

The above objects are achieved by the following present invention. The present invention provides an ink jet recording method using an ink jet recording apparatus having a plurality of aqueous inks that include a cyan ink, a magenta ink and a yellow ink each containing a dye, ink storage portions that respectively store the respective aqueous inks, and a recording head that has a heat-generating portion to generate thermal energy and ejects the aqueous inks by action of the thermal energy, the method including ejecting the aqueous inks from the recording head to record an image on a recording medium. In the method, the recording head is formed by arranging a plurality of ejection orifice arrays corresponding to the aqueous inks on one recording element substrate, the ink storage portions are housings formed of a thermoplastic resin and are bonded to the recording head without another member interposed therebetween, a protective layer containing at least one of tantalum and tantalum oxide is formed on a face of the heat-generating portion that comes in contact with the aqueous ink, the ejection orifice arrays include a first ejection orifice array and a second ejection orifice array at both sides and include a third ejection orifice array at a position other than the both sides, and the aqueous inks corresponding to the first, second and third ejection orifice arrays satisfy condition 1 and condition 2 below:

condition 1: a value of dynamic surface tension (mN/m) of the aqueous ink corresponding to the third ejection orifice array is smaller than a maximum value of dynamic surface tension (mN/m) of the aqueous inks corresponding to the first ejection orifice array and the second ejection orifice array, and condition 2: a value of lightness of the aqueous ink corresponding to the third ejection orifice array is larger than a minimum value of lightness of the aqueous inks corresponding to the first ejection orifice array and the second ejection orifice array.

The present invention can solve the problems caused when an ink jet recording apparatus having the structure in which a housing constituting an ink storage portion is bonded to a recording head including a protective layer containing tantalum is used to record images with a plurality of aqueous inks. In other words, the present invention can provide an ink let recording method that enables recording of images on which bleeding is suppressed even when the above ink jet recording apparatus is used. According to the present invention, an ink jet recording apparatus used in the ink jet recording method can also be provided.

Further features of the present invention will become apparent from the following description of exemplary embodiments with reference to the attached drawings.

BRIEF DESCRIPTION OF THE DRAWINGS

FIG. 3A is a front view viewed from an ejection orifice side; and FIG. 3B is a sectional view taken along line 3B-3B in FIG. 3A.

DESCRIPTION OF THE EMBODIMENTS

Figure 1:
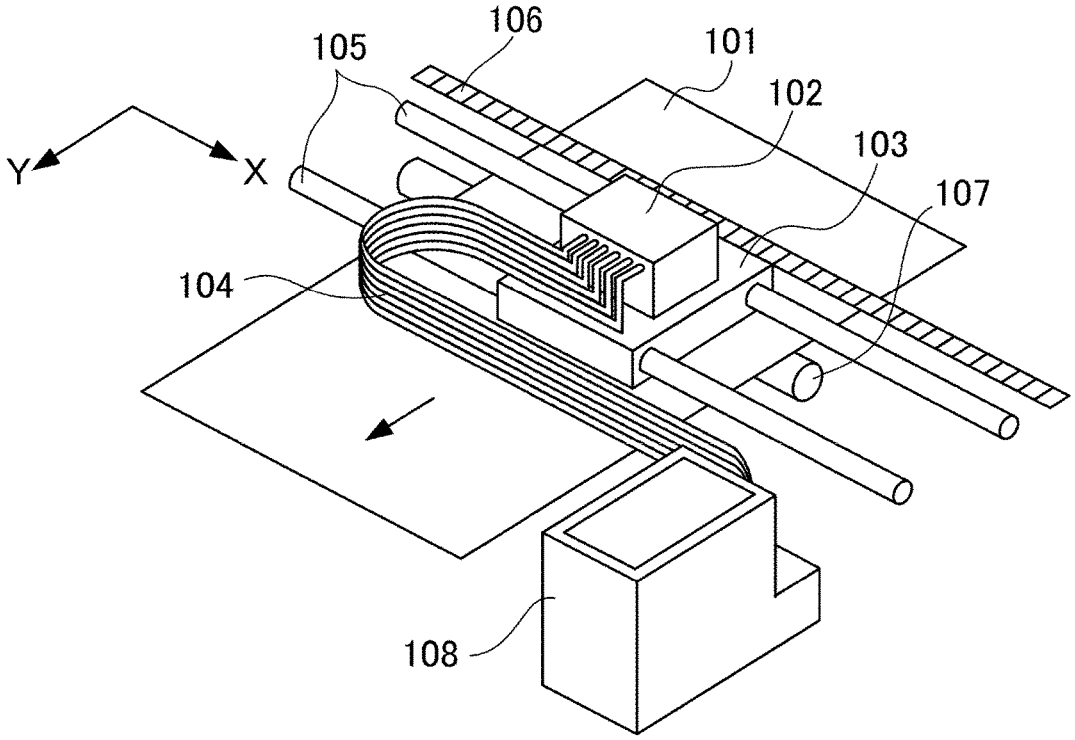
FIG. 1 is a perspective view schematically showing an embodiment of an ink jet recording apparatus of the present invention.

Preferred embodiments of the present invention will now be described in detail in accordance with the accompanying drawings. An aqueous ink for ink jet may also be called "ink". Physical property values are values determined at normal temperature (25° C.) unless otherwise noted.

First, the inventors of the present invention have studied the cause of bleeding when an ink jet recording apparatus having the structure in which a housing constituting an ink storage portion is bonded to a recording head including a protective layer containing tantalum is used to record images with a plurality of inks. The result has indicated that a temperature increase of the recording head in the system of using thermal energy for ejecting inks causes the bleeding. In addition, the temperature of the recording head increases due to the following factors (1) to (3).

(1) Tantalum contained in a protective layer is liable to store heat.

(2) When a recording head (recording element substrate) is bonded to an ink storage portion (housing) without any other member interposed therebetween in order to downsize a recording apparatus, a means for dissipating heat to the outside, such as a heat-dissipating plate, is not included. Such a recording head thus accumulate heat when ejection is repeated.

(3) Of a plurality of ejection orifice arrays arranged on one recording element substrate, an ejection orifice array at a position other than the both sides (third ejection orifice array) is unlikely to dissipate heat due to the effect of heat generated from ejection orifice arrays at the both sides (first ejection orifice array, second ejection orifice array).

In the description, when four or more ejection orifice arrays corresponding to four or more inks are arranged on one recording element substrate, "ejection orifice array at a position other than the both sides" (third ejection orifice array) corresponds to two or more ejection orifice arrays.

The viscosity of an ink decreases as the temperature increases. Accordingly, even if the ejection orifice arrays have similar conditions such as conformations to each other, the energy amount required for ejecting a certain amount of an ink decreases when the temperature of the ink increases. Meanwhile, when the energy amount for ejecting an ink is constant, an increase in temperature of the ink increases the volume of one droplet of the ejected ink. When the temperature of a recording head increases, the temperature of an ink corresponding to the third ejection orifice array is particularly likely to increase, and thus the ink ejection amount from the third ejection orifice array is particularly likely to increase as compared with when the ink is ejected in an environment around normal temperature.

In addition, water is likely to evaporate from an ink corresponding to the third ejection orifice array due to a temperature increase. Particularly in the vicinity of an ejection orifice, the concentration of a dye in an ink varies due to the evaporation of water. When a dye has low solubility in water, the dye is likely to move to a portion containing a large amount of water (a portion apart from the vicinity of the ejection orifice), and this causes dye concentration distribution. When an ink having a high dye concentration is ejected, the resulting image is likely to have a higher optical density to give a dense image with blurring, in cooperation with an increase of the ejection amount due to a temperature increase. To address this, it is required to increase the permeability of an ink into a recording medium in the depth direction to suppress blurring and to make it difficult to visually identify blurring. The blurring on an image recorded with an ink having low lightness is likely to be visually identified. Hence, when the ink corresponding to the third ejection orifice array is an ink having low lightness, the bleeding is likely to be conspicuous. Pigments have lower hydrophilicity than that of dyes and are likely to move to a portion containing a larger amount of water. Accordingly, images and ejection properties are likely to be markedly affected as compared with dyes, and thus dye inks are used in the present invention.

The above discussion indicates that it is important to select an ink corresponding to the third ejection orifice array at a position other than the both sides of the ejection orifice arrays arranged on a recording element substrate, in terms of suppressing bleeding. The inventors of the present invention have found that the following condition 1 and condition 2 are required to be satisfied.

Condition 1: the value of dynamic surface tension (mN/m) of the aqueous ink corresponding to the third ejection orifice array is smaller than the maximum value of the dynamic surface tension (mN/m) of the aqueous inks corresponding to the first ejection orifice array and the second ejection orifice array.

Condition 2: the value of lightness of the aqueous ink corresponding to the third ejection orifice array is larger than the minimum value of lightness of the aqueous inks corresponding to the first ejection orifice array and the second ejection orifice array.

As described above, the temperature of an ink corresponding to the third ejection orifice array is likely to increase, and thus the ejection amount of the ink from the third ejection orifice array is likely to increase. In order to suppress bleeding due to mixing of inks corresponding to the first ejection orifice array and the second ejection orifice array with an ink corresponding to the third ejection orifice array, the ink corresponding to the third ejection orifice array is thus required to be permeated into a recording medium in the depth direction as quickly as possible. When the condition 1 and the condition 2 are satisfied, an ink that has a minimum lightness and thus causes conspicuous bleeding is prevented from being mixed with an ink corresponding to the third ejection orifice array, and the bleeding resistance can be improved.

The permeability of an aqueous ink into a recording medium is in inverse relation to the surface tension of the aqueous ink. In other words, an aqueous ink having a lower surface tension has higher permeability into a recording medium. Blurring between inks is caused by spreading of the inks immediately after the application onto a recording medium. On this account, it is important to control the surface tension in a very short period of time. From the above discussion, the present invention does not use "static surface tension" determined on the basis of the principle of the Wilhelmy method (plate method) or the like but uses a dynamic surface tension at a lifetime of 10 ms (millisecond) determined by the maximum bubble pressure method. The reason of using values at "a lifetime of 10 ms" is that such values accurately match the behavior of an ink in which an interface largely moves, such as an ink during the time period from ejection of the ink from a recording head until immediately after the application onto a recording medium.

The dynamic surface tension of an ink used in the present invention is determined by the maximum bubble pressure method. The maximum bubble pressure method is a method in which a maximum pressure required for discharging a bubble formed at a tip of a probe (narrow tube) immersed in a liquid to be measured is measured to determine the surface tension of the liquid from the measured maximum pressure. Specifically, the maximum pressure is measured while bubbles are continuously formed at the tip of the probe. The time interval from a time point at which a fresh bubble surface is formed at the tip of a probe to a time point at which a maximum bubble pressure is obtained (point at which the curvature radius of a bubble becomes the same as the radius of the tip of the probe) is called "lifetime". Accordingly, the maximum bubble pressure method is a method of measuring the surface tension of a liquid in a moving state.

Blurring of an ink having a small lightness value is likely to be visually identified. When such an ink having a small lightness value is selected as the ink corresponding to the third ejection orifice array that greatly affects the ejection amount and the like, bleeding is likely to be conspicuous. Thus, the ink corresponding to the third ejection orifice array is preferably a magenta ink or a yellow ink when three inks of a cyan ink, a magenta ink, and a yellow ink are used. If the ink corresponding to the third ejection orifice array is a cyan ink, the ejection amount of the cyan ink that has a smallest lightness value increases due to the effect of a temperature increase, and thus bleeding is likely to be conspicuous.

The lightness of an ink used in the present invention is "L value" determined for an image recorded with the ink in terms of the CIE Lab color space. Specifically, a solid image recorded on plain paper under conditions where two ink droplets each having a mass of 5.5 ng are applied in a unit region of 1/600 inch×1/600 inch can be used to determine the lightness (L value) with a spectrophotometer. In the measurement, lightnesses can be compared between images recorded in such a condition that the application amounts of inks are the same per unit area, and thus the recording medium and the like is not limited to particular types.

The ejection orifice arrays are preferably arranged on a recording element substrate in the order corresponding to the cyan ink, the magenta ink, and the yellow ink. When the ejection orifice arrays are arranged in this manner, the bleeding can be more effectively suppressed. In this case, the ink corresponding to the third ejection orifice array is the magenta ink. In other words, the ink that is likely to have a higher temperature and is likely to be ejected in a larger amount is the magenta ink. In this case, the difference in lightness between the cyan ink and the magenta ink and the difference in lightness between the magenta ink and the yellow ink are not so large, and thus bleeding is unlikely to be conspicuous.

An ink having a low surface tension is likely to move toward an ink having a high surface tension. This is likely to cause blurring between the inks. On this account, an ink having a larger lightness value preferably has a smaller dynamic surface tension value at a lifetime of 10 ms as determined by the maximum bubble pressure method. This can further effectively suppress the bleeding. Specifically, the dynamic surface tension $\gamma_C$ (mN/m) of the cyan ink, the dynamic surface tension $\gamma_M$ (mN/m) of the magenta ink, and the dynamic surface tension $\gamma_Y$ (mN/m) of the yellow ink preferably satisfy the relation of $\gamma_C > \gamma_M > \gamma_Y$.

The ink jet recording method of the present invention and an ink jet recording apparatus, a recording head, an aqueous ink, and the like suitably used in the ink jet recording method will now be described.

<General Structure of Ink Jet Recording Apparatus>

The ink jet recording method of the present invention is a recording method using an ink jet recording apparatus that includes a plurality of aqueous inks each containing a dye, ink storage portions that respectively store the respective aqueous inks, and a recording head that ejects the aqueous inks by the action of thermal energy. The aqueous inks include a cyan ink, a magenta ink, and a yellow ink. The recording head has a heat-generating portion that generates thermal energy. The ink jet recording method of the present invention and an ink jet recording apparatus used in the method will be specifically described hereinafter with reference to drawings.

FIG. 1 is a perspective view schematically showing an embodiment of the ink jet recording apparatus of the present invention. The ink jet recording apparatus of the embodiment shown in FIG. 1 is what is called a serial-type ink jet recording apparatus that records images by bi-directional scanning of a recording head in the X direction (main scanning direction). A recording medium 101 is intermittently conveyed in the Y direction (sub scanning direction) by a conveyor roller 107. A recording unit 102 installed on a carriage 103 is reciprocated and scanned in the X direction (main scanning direction) orthogonal to the Y direction that is the conveyance direction of the recording medium 101. By the conveyance of the recording medium 101 in the Y direction and the bi-directional scanning of the recording unit 102 in the X direction, recording is performed.

Figure 2:
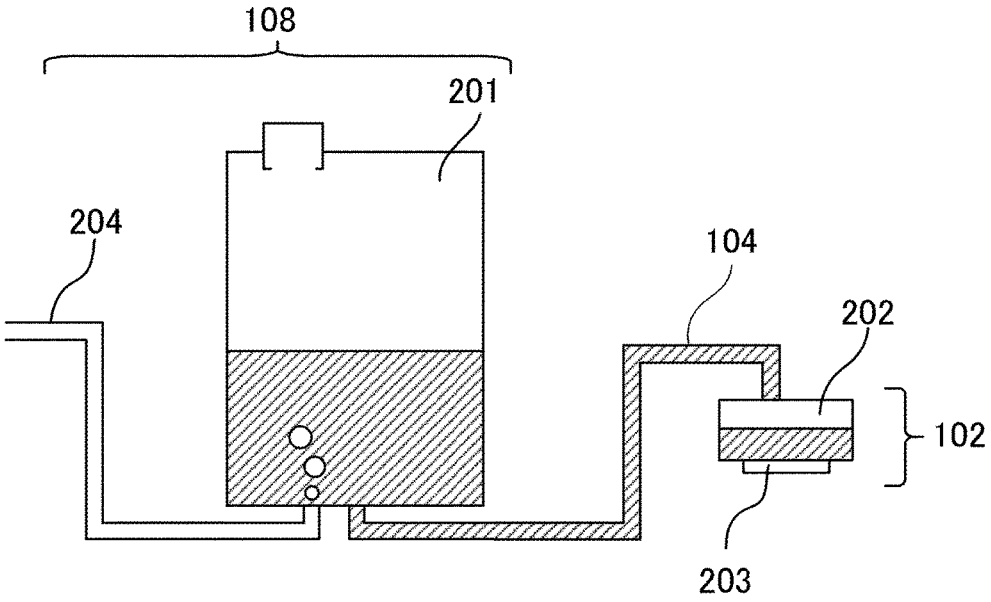
FIG. 2 is a schematic view showing an example of an ink supply system.

FIG. 2 is a schematic view showing an example of an ink supply system. As shown in FIG. 2, the recording unit 102 includes an ink jet recording head 203 having a plurality of ejection orifices from which a supplied ink is elected and includes a sub tank 202 as the second ink storage portion. The recording unit 102 is installed on a carriage 103 as shown in FIG. 1. The carriage 103 is supported in such a way as to be movable along guide rails 105 placed along the X direction and is fixed to an endless belt 106 that moves in parallel with the guide rails 105. The endless belt 106 reciprocates by the driving force of a motor. The carriage 103 is reciprocated and scanned in the X direction by the reciprocation of the endless belt 106.

As shown in FIG. 2, a main tank 201 as the first ink storage portion is stored in a main tank storage portion 108. The main tank 201 in the main tank storage portion 108 and the sub tank 202 in the recording unit 102 are connected through an ink supply tube 104. An ink is supplied from the main tank 201 to the sub tank 202 through the ink supply tube 104 and then is ejected from the ejection orifices on the recording head 203. The numbers of main tanks, sub tanks, and ink supply tubes may correspond to the number of inks.

An ink (indicated by the hatching) stored in the main tank 201 is supplied through the ink supply tube 104 to the sub tank 202 and then is supplied to the recording head 203. To the main tank 201, a gas inlet tube 204 as an atmosphere communicating portion is connected. When an ink is consumed by image recording, a corresponding ink is supplied from the main tank 201 to the sub tank 202, and the ink in the main tank 201 is reduced. When the ink in the main tank 201 is reduced, air is introduced from the gas inlet tube 204 having one end open to the atmosphere, into the main tank 201, and thus a negative pressure for holding an ink in the ink supply system is kept substantially constant.

The main tank 201 preferably has a maximum ink volume $V_1$ (mL) of 60.0 mL or more to 200.0 mL or less and more preferably 60.0 mL or more to 150.0 mL or less. The sub tank 202 preferably has a maximum ink volume $V_2$ (mL) of 1.0 mL or more to 35.0 mL or less, more preferably 2.0 mL or more to 20.0 mL or less, and particularly preferably 5.0 mL or more to 15.0 mL or less.

The first ink storage portion and the second ink storage portion (housings) can be formed of a thermoplastic resin such as polyester, polycarbonate, polypropylene, polyethylene, polystyrene, and polyphenylene ether; or a mixture or a modified material of such thermoplastic resins, for example. In the housing, an ink absorber capable of generating a negative pressure for holding an ink may be provided. The ink absorber is preferably compressed fibers made of a resin such as polypropylene and polyurethane. Alternatively, no ink absorber is provided in a housing, and an ink may be directly stored in the housing.

The recording unit 102 of the embodiment shown in FIG. 2 includes the recording head 203 and the sub tank 202. A recording unit in which the sub tank and the recording head are integrally formed may be installed on the carriage. In the present invention, the sub tank 202 as the second ink storage portion is a housing made of a thermoplastic resin and is directly bonded to the recording head (recording element substrate) 203 without other members such as a heat-dissipating plate interposed therebetween as shown in FIGS. 1 and 2. The presence of an adhesive or the like for bonding the housing and the recording element substrate is not intended to be eliminated. The ink ejection system of the recording head 203 is a system of applying thermal energy to an ink to eject the ink.

Figure 3A:
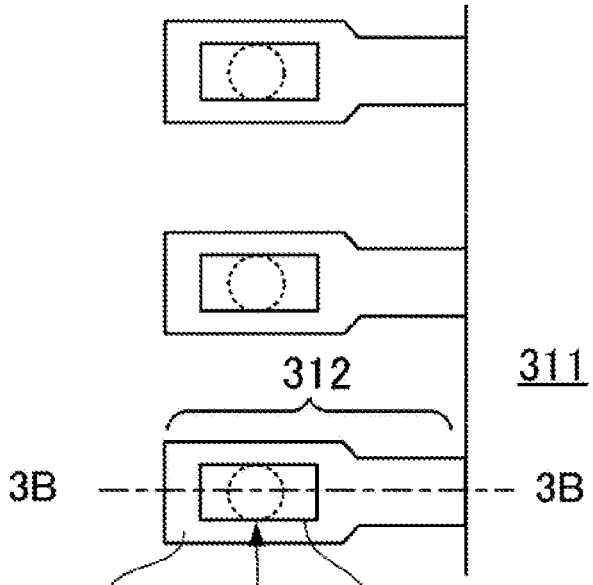
FIGS. 3A and 3B are schematic views showing an example of a recording element substrate.
Figure 3B:
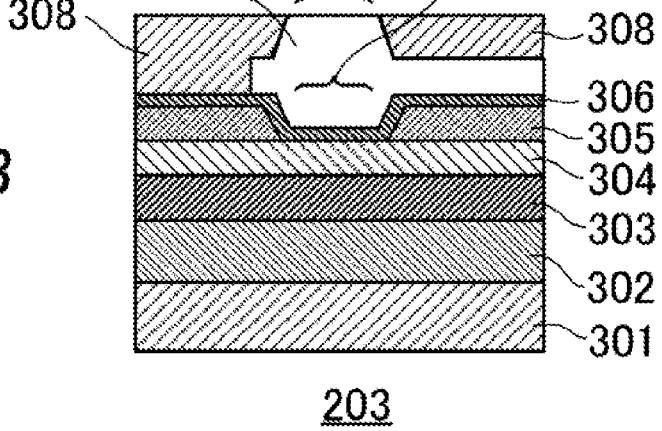

FIGS. 3A and 3B are schematic views showing an example of a recording element substrate; FIG. 3A is a front view viewed from an ejection orifice side; and FIG. 3B is a sectional view taken along line 3B-3B in FIG. 3A. As shown in FIGS. 3A and 3B, the recording head 203 is formed by sequentially stacking a silicon substrate 301, a heat storage layer 302, an inter-stacking layer 303, a heat-generating resistance layer 304, a metal wiring layer 305, a protective layer 306, and a flow path forming member 308. Thermal energy generated from a heat-generating portion 307 in the heat-generating resistance layer 304 such as a heater is applied to an ink in a liquid chamber 310 of a nozzle 312. By the flow path forming member 308 provided on the protective layer 306, an ejection element including an ejection orifice 309 for ejecting an ink is formed. The heat-generating portion 307 is not only exposed to high temperature but also affected by the impact of cavitation associated with foaming of an ink and subsequent shrinkage of bubbles and by chemical action by an ink. To protect the heat-generating portion 307 from various actions, a protective layer 306 containing at least one of tantalum and tantalum oxide is formed on the face of the heat-generating portion 307 that comes in contact with an ink. An ink is supplied from a common liquid chamber 311 provided adjacent to the liquid chamber 310 into the liquid chamber 310. The ink is extruded from the ejection orifice 309 by bubbles formed by the thermal energy generated from the heat-generating portion 307 and is ejected as ink droplets.

<Aqueous Ink>

The ink jet recording method of the present invention uses an ink jet recording apparatus that uses a plurality of aqueous inks including a cyan ink, a magenta ink and a yellow ink each containing a dye. By using this ink jet recording apparatus, the aqueous inks are ejected from a recording head by the action of thermal energy to record an image on a recording medium. In the ink jet recording method of the present invention, a liquid that causes reaction or viscosity increase upon contact with an aqueous ink is not necessary used in combination. The plurality of aqueous inks including the cyan ink, the magenta ink, and the yellow ink will next be described in detail.

Coloring Material

As the coloring material, a dye is used. In the aqueous ink, the content (% by mass) of the dye is preferably 0.1% by mass or more to 15.0% by mass or less and more preferably 1.0% by mass or more to 10.0% by mass or less based on the total mass of the ink.

The dye used as the coloring material is not limited to particular types. Specific examples of the dye include direct dyes, acid dyes, basic dyes, disperse dyes, and food dyes. Of them, a dye having an anionic group is preferably used. Specific examples of the dye skeleton include azo, triphenylmethane, phthalocyanine, azaphthalocyanine, xanthene, and anthrapyridone. The dye contained in the magenta ink preferably includes C.I. Acid Red 249. By using a magenta ink containing C.I. Acid Red 249, the bleeding resistance can be further improved.

The magnitude order of water-solubility of dyes contained in the plurality of aqueous inks is preferably in inverse relation to the magnitude order of lightness of the aqueous inks. Specifically, the water-solubilities of dyes contained in the cyan ink, the magenta ink, and the yellow ink are indicated by $S_C$, $S_M$, and $S_Y$, respectively, and the lightnesses of the cyan ink, the magenta ink, and the yellow ink are indicated by $L_C$, $L_M$, and $L_Y$, respectively. The inks preferably satisfy the relationships of $S_Y>S_M>S_C$ and $L_C>L_M>L_Y$. When the water-solubilities of the dyes and the lightnesses of the aqueous inks satisfy the above relationships, the bleeding resistance can be further improved for the following reasons. When water evaporates to increase the concentration of a dye, a dense image with blurring is recorded as described above. In this case, an ink having a lower lightness is likely to give an image on which blurring is likely to be visually identified. When an ink having a low lightness contains a dye having high solubility in water, the dye is unlikely to move toward a portion containing a large amount of water. Accordingly, the dye concentration is unlikely to increase even when water evaporates, thus the blurring on an image is suppressed, and the bleeding is more unlikely to be caused. When one ink contains a plurality of dyes, the water-solubility of at least one of the dyes preferably satisfies the above relationship. In the present invention, "water-solubility of a dye" means a maximum mass (g) of the dye in a sodium salt form that can be dissolved in 100 g of pure water at 20° C.

Aqueous Medium

The aqueous ink can contain water or an aqueous medium that is a mixed solvent of water and a water-soluble organic solvent. The water-soluble organic solvent can be exemplified by solvents usable in ink jet inks, such as alcohols, (poly)alkylene glycols, glycol ethers, nitrogen-containing compounds, and sulfur-containing compound. These water-soluble organic solvents can be used singly or as a mixture of two or more of them. In the aqueous ink, the content (% by mass) of the water-soluble organic solvent is preferably 3.0% by mass or more to 50.0% by mass or less based on the total mass of the ink. As the water, deionized water or ion-exchanged water is preferably used. In the aqueous ink, the content (% by mass) of water is preferably 50.0% by mass or more to 95.0% by mass or less based on the total mass of the ink.

Other Components

The aqueous ink may contain various additives such as a surfactant, an antifoaming agent, a pH adjuster, an antiseptic agent, an antifungal agent, an antioxidant, and a reduction inhibitor, as needed.

Physical Properties of Ink

The aqueous ink preferably has a dynamic surface tension at a lifetime of 10 ms of 30.0 mN/m or more to 50.0 mN/m or less and more preferably 35.0 mN/m or more to 45.0 mN/m or less. Specifically, the ink corresponding to the third ejection orifice array at a position other than the both sides preferably has a dynamic surface tension of 38.0 mN/m or more to 42.0 mN/m or less.

The dynamic surface tension at a lifetime of 10 ms of each ink can be controlled, for example, by using a surfactant or a water-soluble organic solvent. The surfactant is not limited to particular types. The surfactant can be exemplified by surfactants having skeletons such as hydrocarbon skeletons, fluorine skeletons, and silicone skeletons. Any of nonionic, anionic, cationic, and amphoteric surfactants can be used, for example. In the aqueous ink, the content (% by mass) of the surfactant is preferably 0.1% by mass or more to 5.0% by mass or less and more preferably 0.5% by mass or more to 1.5% by mass or less based on the total mass of the ink. The water-soluble organic solvent used for controlling the dynamic surface tension is preferably a permeable solvent such as alcohols and glycol ethers. Alternatively, a surfactant and a water-soluble organic solvent can be used in combination to control the dynamic surface tension of an aqueous ink.

The aqueous ink preferably has a viscosity of 1.0 mPa·s or more to 5.0 mPa·s or less and more preferably 1.0 mPa·s or more to 3.0 mPa·s or less at 25° C. The ink preferably has a static surface tension of 25.0 mN/m or more to 45.0 mN/m or less and more preferably 30.0 mN/m or more to 40.0 mN/m or less at 25° C. The ink preferably has a pH of 5 or more to 9 or less at 25° C.

EXAMPLES

The present invention will next be described in further detail with reference to examples, comparative examples, and reference examples, but the invention is not intended to be limited to the following examples without departing from the gist of the invention. The component amounts with "part" or are based on mass unless otherwise noted.

<Preparation of Ink>

Components (unit: %) shown in the upper rows in Table 1 were mixed and thoroughly stirred, and the resulting mixtures were subjected to pressure filtration through a microfilter with a pore size of 3.0 (manufactured by Fujifilm Corporation), giving each ink. "Acetylenol E 100" in Table 1 is the trade name of a nonionic surfactant (ethylene oxide adduct of acetylene glycol) manufactured by Kawaken Fine Chemicals. As "cyan dye 1", "yellow dye 1", and "black dye 1", the compounds represented by Formulae (1) to (3) were used, respectively. Each value (g) in the parentheses appended to the dyes represents the water-solubility of the corresponding dye, and means a maximum mass (g) of the dye in a sodium salt form that can be dissolved in 100 g of pure water at 20° C. The lower rows in Table 1 show dynamic surface tensions (mN/m) and lightnesses of inks. The dynamic surface tension of an ink was determined by using a dynamic surface tensiometer (trade name "Bubble Pressure Tensiometer BP2", manufactured by KRUSS) under a condition of a temperature of 25° C. The lightness of an ink was determined with a spectrophotometer under conditions of a D50 light source and a visual field of 2° by using a solid image recorded on plain paper under conditions where two ink droplets each having a mass of 5.5 ng were applied in a unit region of 1/600 inch×1/600 inch. The plain paper used was trade name "GF-500" (manufactured by Canon). The spectrophotometer used was trade name "Spectrolino" (manufactured by Gretag Macbeth).

(1)

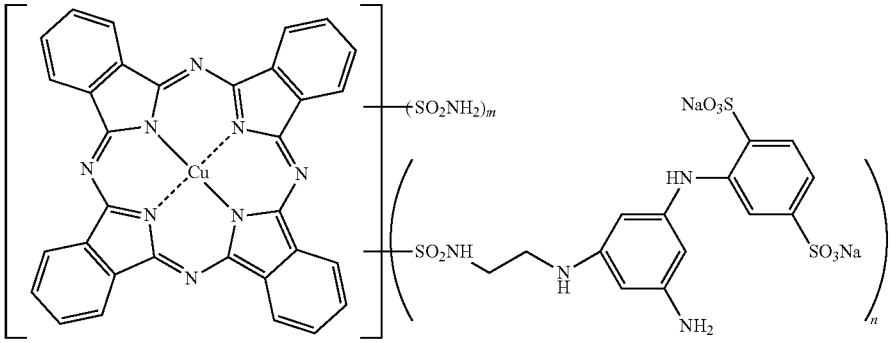

(2)

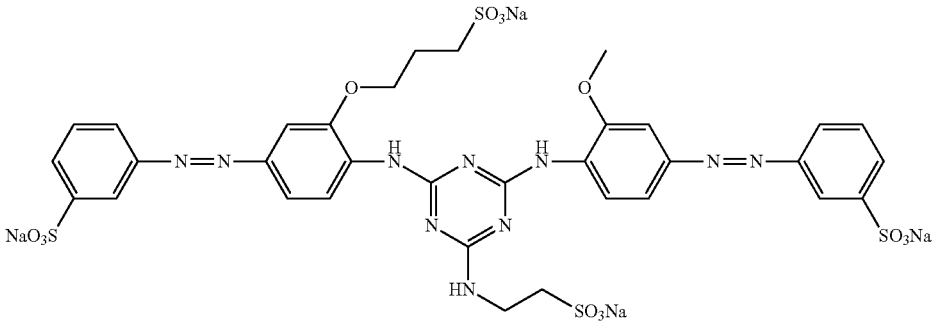

(3)

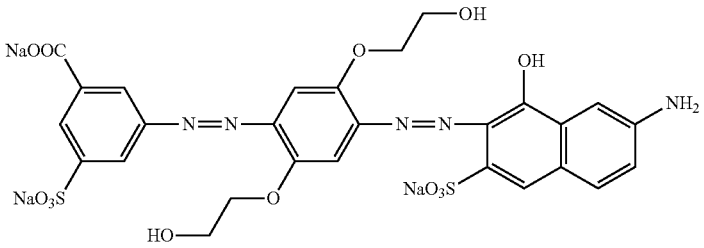

TABLE 1

| Composition and properties of ink | | | | | | | | | | | | | | |
|---|---|---|---|---|---|---|---|---|---|---|---|---|---|---|
| | Ink | | | | | | | | | | | | | |
| | C1 | C2 | C3 | C4 | C5 | M1 | M2 | M3 | M4 | Y1 | Y2 | Y3 | Y4 | Bk1 |
| C.I. Direct Blue 199 (30 g) | 3.00 | 3.00 | 3.00 | 3.00 | | | | | | | | | | 0.10 |
| C.I. Acid Blue 9 (40 g) | 0.20 | 0.20 | 0.20 | | 0.20 | | | | | | | | | |
| Cyan dye 1 (20 g) | | | | | 3.00 | | | | | | | | | |
| C.I. Direct Red 249 (21 g) | | | | | | 3.20 | 3.20 | 3.20 | | | | | | |
| C.I. Acid Red 289 (14 g) | | | | | | | | | 2.50 | | | | | |
| C.I. Direct Yellow 132 (12 g ) | | | | | | | | | | 3.20 | 3.20 | | | |
| C.I. Direct Yellow 86 (10 g) | | | | | | | | | | | | 3.20 | | 0.10 |
| Yellow dye 1 (24 g) | | | | | | | | | | | | | 3.20 | |
| Black dye 1 (20 g) | | | | | | | | | | | | | | 3.00 |
| Glycerol | 7.50 | 7.50 | 7.50 | 7.50 | 7.50 | 7.50 | 7.50 | 7.50 | 7.50 | 7.50 | 7.50 | 7.50 | 7.50 | 7.50 |
| Ethylene glycol | 7.50 | 7.50 | 7.50 | 7.50 | 7.50 | 7.50 | 7.50 | 7.50 | 7.50 | 7.50 | 7.50 | 7.50 | 7.50 | 7.50 |
| Diethylene glycol | 7.50 | 7.50 | 7.50 | 7.50 | 7.50 | 7.50 | 7.50 | 7.50 | 7.50 | 7.50 | 7.50 | 7.50 | 7.50 | 7.50 |
| Acetylenol E 100 | 0.35 | 0.50 | 0.60 | 0.35 | 0.35 | 0.80 | 1.00 | 1.20 | 0.90 | 0.85 | 0.90 | 0.90 | 0.90 | 0.50 |
| Ion-exchanged water | 73.95 | 73.80 | 73.70 | 74.15 | 73.95 | 73.50 | 73.30 | 73.10 | 74.10 | 73.45 | 73.40 | 73.40 | 73.40 | 73.80 |
| Dynamic surface tension (mN/m) | 41.0 | 40.0 | 39.5 | 41.0 | 41.0 | 41.0 | 40.0 | 39.5 | 40.0 | 40.0 | 39.5 | 39.5 | 39.5 | 39.5 |
| Lightness | 50 | 50 | 50 | 51 | 50 | 54 | 54 | 54 | 53 | 85 | 85 | 84 | 82 | 5 |

<Evaluation>

A serial-type ink jet recording apparatus having the principal part structure shown in FIG. 1 and having incorporated therein an ink supply system of the structure shown in FIG. 2 was prepared. Inks corresponding to the ejection orifice arrays shown in Table 2 were injected from the main tanks to fill the ink supply system with the ink. The ejection orifice arrays shown in Table 2 are listed from the left to the right of the recording head as viewed from the front. On the recording element substrate, ejection orifice arrays are arranged, wherein the number of the ejection orifice arrays corresponds to the number of inks to be used. The structures of the sub tanks and the recording element substrates used in Examples, Comparative Examples, and Reference Examples are shown below.

[Structure of Sub Tank]

Examples 1 to 10, Comparative Examples 1 to 4

A sub tank had the structure in which a thermoplastic resin housing was bonded to a recording element substrate provided with a recording head for ejecting ink by application of thermal energy. On the face of the heat-generating portion to come in contact with inks in the recording head, a protective layer containing tantalum was provided.

Reference Examples 1, 3, and 5

A sub tank had the structure in which a thermoplastic resin housing was bonded to a recording element substrate provided with a recording head for electing ink by application of thermal energy. On the face of the heat-generating portion to come in contact with ink in the recording head, no protective layer was provided.

Reference Examples 2, 4, and 6

A sub tank had the structure in which a thermoplastic resin housing was bonded to a recording element substrate provided with a recording head for ejecting ink by application of thermal energy with an alumina heat-dissipating plate interposed therebetween. On the face of the heat-generating portion to come in contact with inks in the recording head, no protective layer was provided.

[Structure of Ejection Orifice Arrays on Recording Element Substrate]

Examples 1 to 9, Comparative Examples 1 to 3, Reference Examples 1 to 6

Three ejection orifice arrays corresponding to three inks were arranged on one recording element substrate.

Example 10, Comparative Example 4

Four ejection orifice arrays corresponding to four inks were arranged on one recording element substrate.

In the present examples, the recording duty of a solid image recorded under conditions where two ink droplets each having a mass of 5.5 ng were applied to a unit region of 1/600 inch×1/600 inch was defined as 100%. In the present invention, "A" and "B" based on the following criteria were regarded as an acceptable level, and "C" and "D" based on the following criteria were regarded as an unacceptable level. The evaluation results are shown in Table 2.

Bleeding Resistance

The above ink jet recording apparatus was used to record images with a pattern shown below on a recording medium (plain paper, trade name "Canon Office", manufactured by Canon).

In the Case of Evaluation of Three Inks

A pattern was employed in which a solid image (0.5 mm in length×2 cm in width) was recorded with an ink corresponding the center array at a recording duty of 100%, and adjacent to the upper and lower sides of the solid image, solid images (2 mm in length×2 cm in width) were recorded with inks corresponding to the right array and the left array at a recording duty of 70%.

In the Case of Evaluation of Four Inks

A pattern (i) was employed which was the same as "in the case of evaluation of three inks" except that the ink corresponding to the center array was that of the left side of the center array, and another pattern (ii) was employed which was the same as "in the case of evaluation of three inks" except that the ink corresponding to the center array was that of the right side of the center array.

The boundary areas of the solid images on the recorded pattern were visually observed, and the bleeding resistance was evaluated based on the following criteria.

A: No bleeding was observed in either the upper or lower boundary area.

B: Bleeding was observed in one of the upper and lower boundary areas, but the boundaries were identified.

C: Bleeding was observed in both the upper and lower boundary areas, but the boundaries were identified.

D: Bleeding was observed to such an extent as not to identify a boundary in at least one of the upper and lower boundary areas.

Ejection Property

The above ink jet recording apparatus was used to record 3,000 solid images on the whole area of recording media with an A4 size (plain paper, trade name "Canon Office", manufactured by Canon) where the inks successively overlapped at a recording duty of 10%. Then, each ink was used to record a vertical line on the same recording medium. The recorded vertical lines were visually observed, and the ejection property was evaluated based on the following criteria.

A: Each ink was normally ejected.

At least one of the inks caused irregular ejection or ejection failure.

TABLE 2

Evaluation conditions and evaluation results

| | | Evaluation conditions | | | | | Evaluation results | |
|---|---|---|---|---|---|---|---|---|
| | | | | Ink corresponding to ejection orifice array | | | | |
| | | Tantalum layer | Heat-dissipating plate | Left array | Center array | Right array | Bleeding resistance | Ejection properties |
| Example | 1 | Yes | No | C1 | M2 | Y2 | A | A |
| | 2 | Yes | No | C4 | M2 | Y2 | A | A |
| | 3 | Yes | No | C5 | M2 | Y2 | A | A |
| | 4 | Yes | No | C1 | M2 | Y2 | A | A |
| | 5 | Yes | No | C1 | M4 | Y2 | B | A |
| | 6 | Yes | No | C1 | M4 | Y4 | B | A |
| | 7 | Yes | No | C1 | Y4 | M4 | B | A |
| | 8 | Yes | No | C1 | M2 | Y1 | B | A |
| | 9 | Yes | No | C1 | M3 | Y1 | B | A |
| | 10 | Yes | No | Bk1 | C3/M3 | Y1 | B | A |
| Comparative Example | 1 | Yes | No | C2 | M1 | Y1 | D | A |
| | 2 | Yes | No | M1 | C2 | Y1 | D | A |
| | 3 | Yes | No | C2 | M2 | Y1 | C | A |
| | 4 | Yes | No | M1 | C2/Bk1 | Y1 | D | A |
| Reference Example | 1 | No | No | C1 | M2 | Y2 | A | C |
| | 2 | No | Yes | C1 | M2 | Y2 | A | C |
| | 3 | No | No | C2 | M1 | Y1 | A | C |
| | 4 | No | Yes | C2 | M1 | Y1 | A | C |
| | 5 | No | No | M1 | C2 | Y1 | A | C |
| | 6 | No | Yes | M1 | C2 | Y1 | A | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-213660, filed Oct. 30, 2015, which is hereby incorporated by reference herein in its entirety.

What is claimed is:

1. An ink jet recording method using an ink jet recording apparatus having a plurality of aqueous inks that include a cyan ink, a magenta ink and a yellow ink each comprising a dye, ink storage portions that respectively store the respective aqueous inks, and a recording head that has a heat-generating portion to generate thermal energy and ejects the aqueous inks by action of the thermal energy, the method comprising ejecting the aqueous inks from the recording head to record an image on a recording medium, wherein the recording head is formed by arranging a plurality of ejection orifice arrays corresponding to the aqueous inks on one recording element substrate, the ink storage portions are housings formed of a thermoplastic resin, said ink storage portions being integrally formed in the recording head without any another member being interposed therebetween, a protective layer comprising at least one of tantalum and tantalum oxide is formed on a face of the heat-generating portion that comes in contact with the aqueous inks, and the ejection orifice arrays include a first ejection orifice array and a second ejection orifice array at both sides and include a third ejection orifice array at a position between the first and second ejection orifice arrays, and the aqueous inks corresponding to the first, second and third ejection orifice arrays satisfy condition 1 and condition 2 below:

condition 1: a value of dynamic surface tension (mN/m) of the aqueous ink corresponding to the third ejection orifice array is smaller than a maximum value of dynamic surface tension (mN/m) of the aqueous inks corresponding to the first ejection orifice array and the second ejection orifice array, and condition 2: a value of lightness of the aqueous ink corresponding to the third ejection orifice array is larger than a minimum value of lightness of the aqueous inks corresponding to the first ejection orifice array and the second ejection orifice array.

2. The ink jet recording method according to claim 1, wherein a magnitude order of water-solubility of the dye contained in the aqueous inks is in inverse relation to a magnitude order of lightness of the aqueous inks.

3. The ink jet recording method according to claim 1, wherein the ejection orifice arrays are arranged on the recording element substrate in an order corresponding to the cyan ink, the magenta ink, and the yellow ink.

4. The ink jet recording method according to claim 1, wherein the dynamic surface tension $\gamma_C$ (mN/m) of the cyan ink, the dynamic surface tension $\gamma_M$ (mN/m) of the magenta ink, and the dynamic surface tension $\gamma_Y$ (mN/m) of the yellow ink satisfy the relationship of $\gamma_C > \gamma_M > \gamma_Y$.

5. The ink jet recording method according to claim 1, wherein the dye contained in the magenta ink comprises C.I. Acid Red 249.

6. The ink jet recording method according to claim 1, wherein said another member is a heat-dissipating plate.

7. An ink jet recording apparatus for use in the ink jet recording method according to claim 1, the apparatus comprising:

a plurality of aqueous inks that include a cyan ink, a magenta ink, and a yellow ink each comprising a dye;

ink storage portions that respectively store the respective aqueous inks; and a recording head that has a heat-generating portion to generate thermal energy and ejects the aqueous inks by action of the thermal energy, wherein the recording head is formed by arranging a plurality of ejection orifice arrays corresponding to the aqueous inks on one recording element substrate, the ink storage portions are housings formed of a thermoplastic resin, said ink storage portions being integrally formed in the recording head without any other member being interposed therebetween, a protective layer comprising at least one of tantalum and tantalum oxide is formed on a face of the heat-generating portion that comes in contact with the aqueous inks, and the ejection orifice arrays include a first ejection orifice array and a second ejection orifice array at both sides and include a third ejection orifice array at a position between the first and second ejection orifice arrays, and the aqueous inks corresponding to the first, second and third ejection orifice arrays satisfy condition 1 and condition 2 below:

condition 1: a value of dynamic surface tension (mN/m) of the aqueous ink corresponding to the third ejection orifice array is smaller than a maximum value of dynamic surface tension (mN/m) of the aqueous inks corresponding to the first ejection orifice array and the second ejection orifice array, and condition 2: a value of lightness of the aqueous ink corresponding to the third ejection orifice array is larger than a minimum value of lightness of the aqueous inks corresponding to the first ejection orifice array and the second ejection orifice array.

8. The ink jet recording method according to claim 1, wherein a content of the dye in each ink is 0.1 to 15.0% by mass based on the total mass of the ink.

9. The ink jet recording method according to claim 1, wherein the dye contained in the cyan ink comprises a dye having a triphenylmethane or a phthalocyanine skeleton.

10. The ink jet recording method according to claim 1, wherein the dye contained in the magenta ink comprises a dye having an azo or a xanthene skeleton.

11. The ink jet recording method according to claim 1, wherein the dye contained in the yellow ink comprises a dye having an azo skeleton.

12. The ink jet recording method according to claim 1, wherein each ink has a dynamic surface tension at a lifetime of 10 ms of 30.0 to 50.0 mN/m.

13. The ink jet recording method according to claim 1, wherein each ink has a dynamic surface tension at a lifetime of 10 ms of 35.0 to 45.0 mN/m.

14. The ink jet recording method according to claim 1, wherein the magenta ink has a dynamic surface tension at a lifetime of 10 ms of 38.0 to 42.0 mN/m.

* * * * *